US008002103B2

(12) United States Patent
Kusters

(10) Patent No.: US 8,002,103 B2
(45) Date of Patent: Aug. 23, 2011

(54) METHOD AND DEVICE FOR CONTROLLING THE FLOW OF BANKNOTES

(75) Inventor: Gerardus Jacobus Marie Kusters, Velden (NL)

(73) Assignee: Syntech Holdings B.V., Venlo (NL)

( * ) Notice: Subject to any disclaimer, the term of this patent is extended or adjusted under 35 U.S.C. 154(b) by 1649 days.

(21) Appl. No.: 10/873,745

(22) Filed: Jun. 22, 2004

(65) Prior Publication Data

US 2005/0279609 A1 Dec. 22, 2005

(51) Int. Cl.
*G07D 7/16* (2006.01)

(52) U.S. Cl. ..... 194/302; 250/556

(58) Field of Classification Search ..... 194/302, 194/205, 206, 303, 339; 209/534; 73/819; 250/559.2, 559.36; 356/626, 628
See application file for complete search history.

(56) References Cited

U.S. PATENT DOCUMENTS

| | | | | |
|---|---|---|---|---|
| 4,483,124 | A * | 11/1984 | Ohba et al. | 53/54 |
| 4,674,060 | A * | 6/1987 | Larkin et al. | 702/129 |
| 4,830,742 | A * | 5/1989 | Takesako | 209/534 |
| 6,860,375 | B2 * | 3/2005 | Hallowell et al. | 194/328 |
| 6,962,247 | B2 * | 11/2005 | Maier et al. | 194/207 |
| 2005/0011721 | A1 * | 1/2005 | Armanini et al. | 194/207 |

* cited by examiner

*Primary Examiner* — Stefanos Karmis
*Assistant Examiner* — Mark J Beauchaine
(74) *Attorney, Agent, or Firm* — Roberts & Roberts, LLP

(57) ABSTRACT

The invention relates to a method and a device for controlling the flow of banknotes between at least two locations, in particular a Central Bank and/or Monetary Authority and a local financial institution, said method comprising the following steps:

i) collecting banknotes at the local financial institution,
ii) subjecting the banknotes received in step i) to a fitness measurement so as to obtain a flow of "fit" banknotes and a flow of "unfit" banknotes,
iii) returning the flow of "unfit" banknotes to the Central Bank and/or Monetary Authority, and
iv) bringing the flow of "fit" banknotes into circulation.

5 Claims, 1 Drawing Sheet

METHOD AND DEVICE FOR CONTROLLING THE FLOW OF BANKNOTES

The present invention relates to a method and a device for controlling the flow of banknotes between at least two locations, in particular a Central Bank and a local financial institution.

The issue of new banknotes has been assigned by law to a so-called Central Bank and/or Monetary Authority. However, the Central Banks and/or Monetary Authorities also receive the banknotes which are already in circulation and which are subsequently brought into circulation anew. Banknotes comprise authenticity features, however, which may vary with each individual country, region or zone from a few authenticity features in some banknotes to more than twenty authenticity features in the Euro banknotes, for example. Such authenticity features enable the user, the commercial financial institutions and the Central Banks and/or Monetary Authorities to determine the authenticity of a banknote at different levels. Authenticity verification generally takes place upon acceptance of banknotes. At Central Banks and/or Monetary Authorities, the verification of the authenticity features of banknotes is carried out by means of so-called banknote sorting machines, using a so-called "single note" sorting process. This means that all the banknotes, which are usually supplied in bundles of 100, 500 or 1000 units, must first be "unbundled". Subsequently, the unbundled banknotes are mechanically verified one by one, irrespective of their value or their physical condition, by means of so-called sorting machines which carry the banknotes past a series of detectors and sensors. The verification comprises a number of authenticity checks, which can be carried out by means of a machine, as well as all kinds of measurements for determining the present condition or the fitness for use of the banknotes. The aforesaid operations are considered to be cost-intensive operations.

Low-denomination banknotes constitute a substantial part of the total volume of banknotes that is in circulation worldwide. The "single note" sorting process as described above does not offer a desirable solution for handling low-denomination banknotes, in view of the (frequently) poor condition of these banknotes and the high sorting costs at the Central Banks and/or Monetary Authorities. Moreover, the efficiency of a sorting machine will strongly decrease as the physical condition of the banknotes to be processed deteriorates. The quality of low-denomination banknotes is generally inferior to that of high-denomination banknotes. This means that the handling costs of lower-denomination banknotes are disproportionately high in relation to the value that such banknotes represent. In addition, low-denomination banknotes are counterfeited less often than high-denomination banknotes, so that the high sorting costs will outweigh the security risk. In principle, the banknotes are divided into two categories upon sorting, viz. "fit" and "unfit", "unfit" banknotes are destroyed and "fit" banknotes are brought into circulation anew.

Thus it is an object of the present invention to provide a method and a device for controlling the flow of banknotes, wherein only new banknotes of lower denominations are brought into circulation by the Central Bank and/or Monetary Authority.

Another object of the present invention is to provide a method and a device for controlling the flow of banknotes, wherein the destruction of "unfit" banknotes takes place at a central location, in particular at the Central Bank and/or Monetary Authority.

Yet another object of the present invention is to provide a method and a device for controlling the flow of banknotes, wherein the banknotes can be qualified as "fit" or "unfit" in an efficient manner.

The method as referred to in the introduction is characterized in that the method comprises the following steps:

i) collecting banknotes at the local financial institution, ii) subjecting the banknotes received in step i) to a fitness measurement so as to obtain a flow of "fit" banknotes and a flow of "unfit" banknotes, iii) returning the flow of "unfit" banknotes to the Central Bank and/or Monetary Authority, and iv) bringing the flow of "fit" banknotes into circulation.

Figure 1:
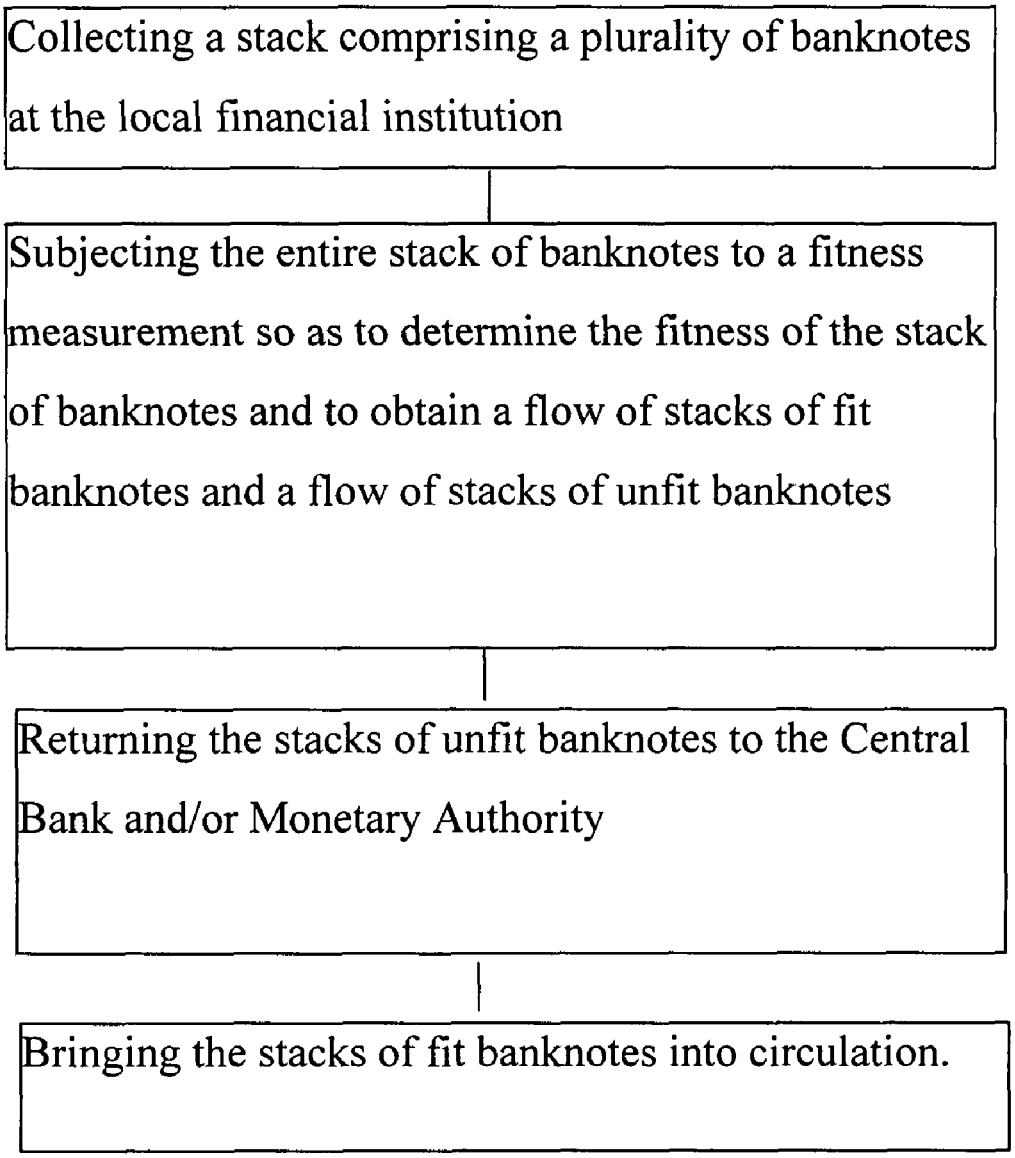
FIG. 1 is a flow chart of the steps of the invention.

One or more of the above objects are accomplished by using the present method, in particular the fact that the large flow of banknotes to the Central Bank and/or Monetary Authority, which previously comprised "fit" as well as "unfit" banknotes, is reduced to only a verified and controllable flow of "unfit" banknotes, which means a significant reduction of administration, transport and handling costs.

On the basis of the present invention a so-called fitness measurement will be carried out at the local financial institution, which measurement in particular comprises a measurement of the compressibility of a stack of banknotes, viz.:

a) providing a stack of banknotes, b) exerting a force on the stack of banknotes obtained in step a), c) determining the relation between the height of the stack of banknotes and the exerted force, and d) qualifying the bundle of banknotes as "fit" or "unfit" on the basis of the relation as measured in step c).

The qualification as mentioned in the present description will take place by means of specially developed software and hardware. The analysis carried out by the software will result in a qualification of the stack of banknotes.

In a special embodiment, step b) preferably comprises a number of substeps, viz.:

$b_1$) exerting a force on the stack of banknotes, so that the stack of banknotes is compressed, wherein the force that is exerted is measured as a function of the height of the stack of banknotes, and $b_2$) measuring the force that the stack of banknotes as compressed in step $b_1$) exerts in order to return to the situation prior to said compression of the stack of banknotes.

From experiments carried out by the Applicant it has become apparent that the curve that is obtained upon exertion of a pressure on a stack of banknotes, for example a bundle or a package, in particular an amount of banknotes comprising a hundred units or a multiple thereof, for example a bundle of 100 or 200 units, with the pressure being measured as a function of height, is different from a curve that is obtained when the compressed stack of banknotes is allowed to return to the original situation, in particular by releasing the pressure that is being exerted thereon. The relation that is obtained exhibits a so-called hysteresis, wherein the difference in the area below the two curves can be considered to be inversely proportional to the fitness of the measured bundle. The value that is thus mathematically formulated, viz. the difference or the ratio between the two integral functions, provides an indication as to the fitness of a bundle of banknotes.

In one preferred embodiment of this fitness measurement, the exertion of a specific force on the stack of banknotes is combined with the measurement the height of the stack of banknotes by a number of sensors. Such a multipoint measurement provides information on local differences in the stack of banknotes, which information is in particular of importance when the stack contains banknotes that are folded in two, for example.

In a special embodiment of the present invention, the fitness measurement carried out in step ii) comprises an optical measurement of a stack of banknotes, viz.:

k) illuminating an edge of the stack of banknotes, l) providing a two-dimensional recording of the edge of the banknotes, and m) mathematically analysing the two-dimensional recording obtained in step l) and qualifying the bundle of banknotes as "fit" or "unfit".

It should be understood that the optical fitness determination is based on a spectrum of grey values, which grey values are dependent on the type of banknotes and consequently must be individually determined for each country of origin and each denomination, which calibration measurement has already been determined in advanced by the present inventors. The mathematical analysis that applies in this case will take place by means of software.

According to yet another embodiment, the fitness measurement carried out in step ii) comprises an acoustic measurement of a stack of banknotes, viz.:

x) passing a sound signal through the bundle of banknotes, y) providing a three-dimensional recording of the propagation of the sound through the bundle of banknotes, and z) mathematically analysing the three-dimensional recording and qualifying the bundle of banknotes as "fit" or "unfit".

The acoustic fitness determination is based on the detection of air chambers in the stack of banknotes. The present inventors assume that the three-dimensional recording shows the location, the size and the distribution of such air chambers, which result is an indication of the fitness of the stack of banknotes. It is assumed that the air chambers will predominate between the banknotes that are creased most. The mathematical analysis will take place by means of software.

In one preferred embodiment, the fitness measurement is carried out by determining the weight of a stack of banknotes. By comparing the measured value with a calibration curve, in which the weight of new banknotes is represented as a function of the number of new banknotes, the stack of banknotes can be qualified as "fit" or "unfit".

According to the present invention, a fitness measurement is thus carried out at the local financial institution on the banknotes that have been received at said institution, which fitness measurement results in the bundle of banknotes being qualified as "fit" or "unfit". Although the present fitness measurements have been referred to herein as separate measuring methods, it is desirable in specific embodiments to carry out the fitness measurements by combining at least two of said measuring methods. It should be understood in this connection that the Central Bank and/or Monetary Authority imposes standards as regards the fit-unfit break-even point, and also as regards the false fit rate and the false unfit rate, on the basis of which it is determined whether a bundle of banknotes is to be declared "fit" or "unfit" in its entirety. If the fitness measurement yields a value below a specific fit-unfit threshold value, the bundle of banknotes is be sealed, identified and prepared for shipment to the Central Bank and/or Monetary Authority. At said Central Bank and/or Monetary Authority, the fitness of the bundle of banknotes is determined anew and if said fitness conforms to a predetermined requirement, the bundle may be processed in a suitable detection system and possibly be destroyed in the end. The system used is a so-called tracking and tracing system, by means of which the Central Bank and/or Monetary Authority retains full control over the status and the handling of the money flow returning from the market.

The present invention further relates to a device for controlling the flow of banknotes between at least two locations, in particular the Central Bank and/or Monetary Authority and the local financial institution, which device comprises:

i) means for collecting the banknotes at the local financial institution, ii) means for subjecting the banknotes received in step i) to a fitness measurement so as to obtain a flow of "fit" banknotes and a flow of "unfit" banknotes, iii) means for returning the flow of "unfit" banknotes to the Central Bank and/or Monetary Authority, and iv) means for bringing the flow of "fit" banknotes into circulation.

To carry out the fitness measurement, the device in particular comprises:

a) means for providing a stack of banknotes, b) means for exerting a force on the stack of banknotes obtained in step a), c) means for determining the relation between the height of the stack of banknotes and the exerted force, and d) means for qualifying the bundle of banknotes as "fit" or "unfit" on the basis of the relation as measured in step c).

Computers are used as the means for qualifying the bundle of banknotes as "fit" or "unfit" on the basis of the relation as measured in step c), which computers in particular comprise software that analyses and interprets the measurement data.

In one preferred embodiment, the present device for carrying out the fitness measurement comprises:

k) means for illuminating an edge of the stack of banknotes, l) means for providing a two-dimensional recording of the edge of the banknotes, and m) means for mathematically analysing the two-dimensional recording obtained in step l) and qualifying the bundle of banknotes as "fit" or "unfit".

Computers are used as the means for mathematically analysing the two-dimensional recording obtained in step l) and qualifying the bundle of banknotes as "fit" or "unfit", which computers in particular comprise software that analyses and interprets the measurement data.

In another preferred embodiment, the device for carrying out the fitness measurement comprises:

x) means for passing a sound signal through the bundle of banknotes, y) means for providing a three-dimensional recording of the propagation of the sound through the bundle of banknotes, and z) means for mathematically analysing the three-dimensional recording and qualifying the bundle of banknotes as "fit" or "unfit".

Computers are used as the means for mathematically analysing the three-dimensional recording obtained in step y) and qualifying the bundle of banknotes as "fit" or "unfit", which computers in particular comprise software that analyses and interprets the measurement data.

The method and the device for controlling the flow of banknotes according to the present invention in particular provide for the flow of banknotes from the markets to the Central Bank and/or Monetary Authority being limited to "unfit" banknotes only. To that end, it is desirable to subject the banknotes that have been collected at the local institution to a fitness measurement, in particular a fitness measurement selected from the group consisting of compressibility measurement, optical measurement and acoustic measurement, which fitness measurement qualifies the banknotes as "fit" or "unfit".

The invention claimed is:

1. A method for controlling the flow of banknotes between at least two locations, a Central Bank and/or Monetary Authority and a local financial institution, wherein the method comprises the following steps:

i) collecting a stack comprising a plurality of banknotes at the local financial institution, ii) subjecting the entire stack of banknotes in step i) to a fitness measurement so as to determine the fitness of the stack of banknotes and to obtain a flow of stacks of fit banknotes and a flow of stacks of unfit banknotes, iii) returning the stacks of unfit banknotes to the Central Bank and/or Monetary Authority, and iv) bringing the stacks of fit banknotes into circulation.

2. The method according to claim 1, wherein the fitness measurement according to step ii) comprises a measurement of the compressibility of a stack of banknotes, which measurement comprises the following steps:

a) providing a stack of banknotes, b) exerting a force on the stack of banknotes obtained in step a), c) determining the relation between the height of the stack of banknotes and the exerted force, and d) qualifying the stack of banknotes as fit or unfit on the basis of the relation as measured in step c).

3. The method according to claim 2 wherein step b) comprises:

$b_1$) exerting a force on the stack of banknotes, so that the stack of banknotes is compressed, wherein the force that is exerted is measured as a function of the height of the stack of banknotes, and $b_2$) measuring the force that the stack of banknotes as compressed in step $b_1$) exerts in order to return to the situation prior to said compression of the stack of banknotes.

4. The method according to claim 1, wherein the fitness measurement carried out in step ii) comprises an optical measurement of a stack of banknotes, which measurement comprises the following steps:

k) illuminating an edge of the stack of banknotes, l) providing a two-dimensional recording of the edge of the banknotes, and m) mathematically analysing the two-dimensional recording obtained in step l) and qualifying the stack of banknotes as fit or unfit.

5. The method according to claim 1, wherein the fitness measurement carried out in step ii) comprises an acoustic measurement of a stack of banknotes, which measurement comprises the following steps:

x) passing a sound signal through the stack of banknotes, y) providing a three-dimensional recording of the propagation of the sound through the stack of banknotes, and z) mathematically analysing the three-dimensional recording and qualifying the stack of banknotes as fit or unfit.

* * * * *